US006343977B1

(12) United States Patent
Peng et al.

(10) Patent No.: US 6,343,977 B1
(45) Date of Patent: Feb. 5, 2002

(54) MULTI-ZONE CONDITIONER FOR CHEMICAL MECHANICAL POLISHING SYSTEM

(75) Inventors: Shuang-Neng Peng, Taipei; Bih-Tiao Lin, Ping Tung Hsien, both of (TW)

(73) Assignee: Worldwide Semiconductor Manufacturing Corp. (TW)

( * ) Notice: Subject to any disclaimer, the term of this patent is extended or adjusted under 35 U.S.C. 154(b) by 0 days.

(21) Appl. No.: 09/525,005

(22) Filed: Mar. 14, 2000

(51) Int. Cl.[7] ..... B24B 1/00

(52) U.S. Cl. ..... 451/56; 451/41; 451/60; 451/242; 451/443; 451/444; 451/446

(58) Field of Search ..... 451/41, 56, 60, 451/242, 443, 444, 446

(56) References Cited

U.S. PATENT DOCUMENTS 5,779,526 A * 7/1998 Gill ..... 451/324
6,086,460 A * 7/2000 Labunsky et al. ..... 451/56
6,220,936 B1 * 4/2001 Quek ..... 451/41

* cited by examiner

*Primary Examiner*—Joseph J. Hail, III
*Assistant Examiner*—Shantese McDonald

(57) ABSTRACT

An apparatus and method for conditioning the polishing pad of CMP system by employing a multi-zone conditioner, or dresser. The conditioner comprises a plurality of rollers or disks, which can be well tuned to make down-pressure and rolling speed of the rollers or disks to the extent as desirable. The conditioner further comprises driving means for rotating the polishing rollers or disks. It can make a better uniformity of the pad conditioning and improve the profile of the polished wafers. The apparatus and method for conditioning the polishing pad can be especially used to compensate the uniformity of the incoming films, or the pre-CMP films.

14 Claims, 5 Drawing Sheets

MULTI-ZONE CONDITIONER FOR CHEMICAL MECHANICAL POLISHING SYSTEM

FIELD OF THE INVENTION

The present invention relates to an apparatus and method for a chemical-mechanical polishing (CMP) system, and more particularly, to an apparatus and method for conditioning the polishing pad of CMP system.

BACKGROUND OF THE INVENTION

The chemical-mechanical polishing (CMP) is a new technology in integrated circuits (IC) manufacturing industry. During a process of IC manufacturing, a planarization process is often applied to perform on the surface of a semiconductor wafer. Of the different processes of planarization, CMP is the most effective one in "global planarization" technology, that is, it can provide a fully planar surface of semiconductor wafers. And chemical-mechanical polishing is one of the most widely used processes for planarization before performing a multilevel metallization process.

Typically, a basic configuration of a CMP apparatus includes a polishing platen for holding a polishing pad, a wafer holder for holding a semiconductor wafer. Generally, the polishing pad has an abrasive top surface that contacts the semiconductor wafer. Besides, a vacuum chuck (not shown) set in the wafer holder applies negative pressure to the backside of the semiconductor wafer, thereby securely holding the wafer. For the "chemical part", some slurry with specific chemical solutions is continuing to add onto the polishing platen during a CMP process. Usually, the chemical solution is mainly a compound of colloidal silica (or dispersed alumina) mixed with the solutions of potassium hydroxide (KOH) or ammonia ($NH_4OH$). The abrasive materials in the slurry interact with the surface of a wafer in order to remove the unwanted surface layers of the wafer. For the "mechanical part", the material of surface layers of a wafer is removed by the polishing pad. In operation, the wafer holder applies the top surface of the wafer against the abrasive top surface of the polishing pad. And the wafer holder is then rotating at a predetermined speed to polish the wafer against the polishing pad.

A CMP system further includes a conditioner (dresser), which is used to polish and recondition the polishing pad during a polishing process. The conditioning operation is one of the key process parameters. Referring to FIG. 1, it is a cross-sectional view diagram of a prior art polishing apparatus and polishing pad conditioner for CMP system. The wafer holder 100 is used to hold a semiconductor wafer 102. And the wafer holder 100 exerts force on the top surface of the wafer against the abrasive top surface of the polishing pad 104 on a platen 106. The polishing pad 104 is then driven by a drive motor 108 and is rotating at a predetermined speed in order to remove the unwanted material on different layers of the semiconductor wafer 102 thereon. A polishing pad conditioner 110 is applied to polish and recondition the polishing pad 104 during a CMP process. The polishing pad conditioner 110 has a holder 112 and an abrasive grinding layer 114, and the holder 112 is driven to rotate by a drive motor 116. And a top view of the configuration of the conventional polishing apparatus and polishing pad conditioner for CMP system is shown in FIG. 2, wherein the wafer holder 200 and the conventional polishing pad conditioner 202 are over a polishing pad 204.

The main function of applying a conditioner for CMP system is to restore the removal rate performance of the polishing pad; otherwise, the efficiency of the CMP decreases and the throughput of the wafer polishing declines as the CMP process is in proceeding. Because the removal rate of CMP is highly correlated to the conditioning quality of the polishing pad, the functions and performance of a conditioner is demanding. The polishing rate, or the removal rate, of a conventional CMP system will be unstable and not easy to control the removal amount by the pad profile exactly. To make matters worse, the pre-CMP deposition thickness is usually not uniform from the center to the edge. Thus, the peripheral and central portions of the polishing pad will not be removed by the conditioner in order to get a desirable profile. If the pad conditioning (dressing) is not enough or not uniform during CMP process, the polishing rate will be too low and become unstable, and the non-uniformity within a wafer will be even worse. Additionally, in prior art, a conditioner dresses a polishing pad throughout the surface of the pad. In this case, the conditioner can hardly be controlled to generate a specific profile of the pad.

SUMMARY OF THE INVENTION

An apparatus and method for conditioning the polishing pad of CMP system by employing a multi-zone conditioner, or dresser, is disclosed. The conditioner comprises a plurality of rollers or disks, and driving means for rotating the polishing rollers or disks.

The method of conditioning (dressing) is to condition the polishing pad in a multi-zone style. The conditioner comprises a plurality of rollers or disks, which can be well tuned to make down-pressure and rolling speed of the rollers or disks to the extent as desirable. The conditioner further comprises driving means for rotating the polishing rollers or disks. It can make a better uniformity of the pad conditioning and improve the profile of the polished wafers. The apparatus and method for conditioning the polishing pad can be especially used to compensate the uniformity of the incoming films, or the pre-CMP films.

The present invention provides an apparatus and method to improve the conditioning rate and the surface quality of the polishing pad. It provides a stable polishing rate and good non-uniformity within a wafer. Moreover, any desirable profile of polishing pads used to compensate incoming film profiles can be easily obtained by applying the apparatus and method of the present invention. Additionally, a plurality of conditioning units is integrated to one set of the conditioner, and each unit is a roller (or disk) type. The rolling speed and down-pressure of each roller can be adjusted to meet the requirement of the desirable shape on each zone of the polishing pad to obtain the profile as needed. In order to smooth the sharp edge of the portion been conditioning; that is, to get a better uniformity of a polishing pad, the conditioner of the present invention is made to swing horizontally at a small angle. A megasonic or ultrasonic jet can be applied to further improve the pad defects.

BRIEF DESCRIPTION OF THE DRAWINGS

The advantages and other features of the present invention will be more readily appreciated from the following detailed description of the present invention taken in conjunction with the accompanying drawings, wherein.

DETAILED DESCRIPTION OF THE PREFERRED EMBODIMENT

Figure 1:
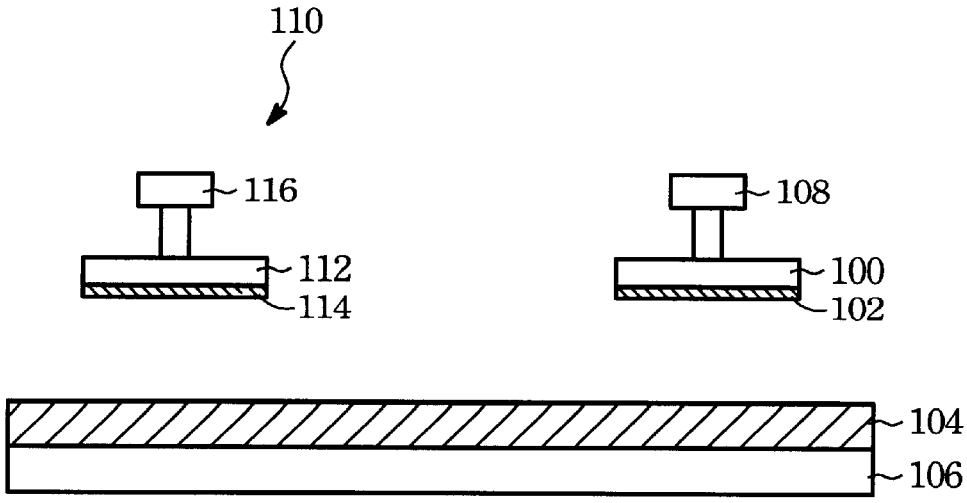
FIG.1 ( Prior Art )
FIG. 1 is a cross-sectional view diagram of a prior art polishing apparatus and polishing pad conditioner for CMP system.
Figure 2:
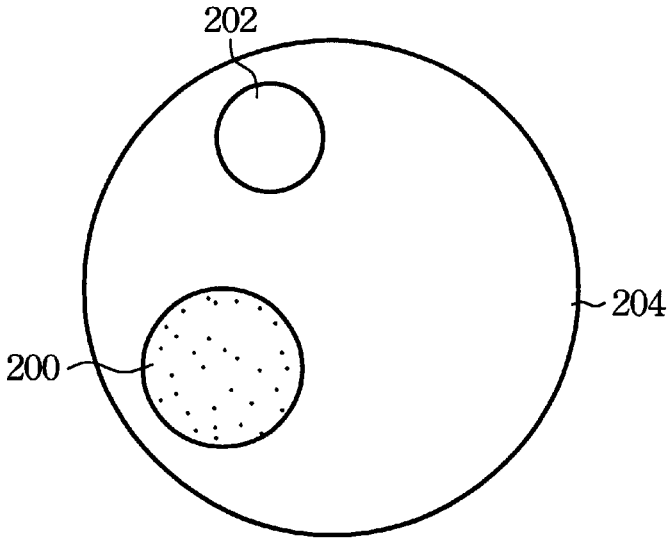
FIG.2 ( Prior Art )
FIG. 2 is a top view diagram of a prior art polishing apparatus and polishing pad conditioner for CMP system as shown in FIG. 1.
Figure 3A:
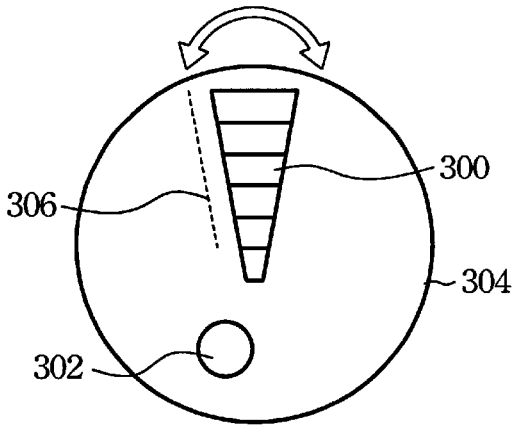
FIG. 3A is a schematic diagram (top view) of a polishing apparatus and polishing pad conditioner of the present invention on a disk polishing pad.
Figure 3B:
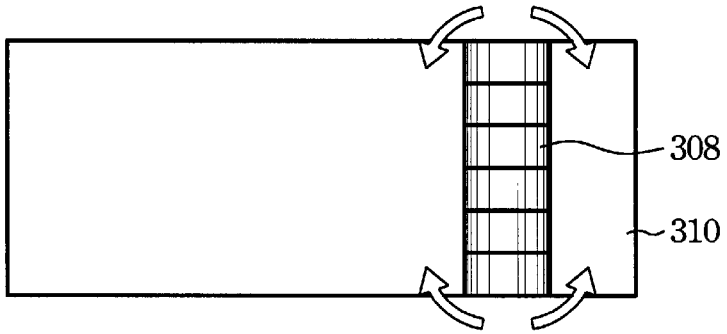
FIG. 3B is a schematic diagram (top view) of a polishing apparatus and one set of polishing pad conditioner of the present invention on a linear polishing pad.
Figure 3C:
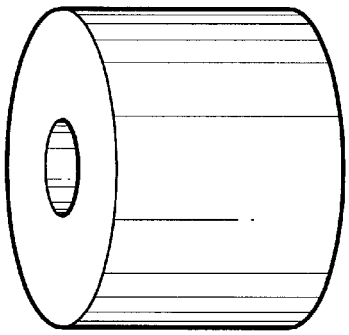
FIG. 3C is a three-dimensional view of a roller of the polishing pad conditioner of the present invention.

Referring to FIG. 3A, it's a top view schematic diagram of a polishing apparatus and polishing pad conditioner of the present invention. The novel roller polishing pad conditioner consists of a plurality of rollers with an abrasive grinding layer around the cylindrical sides. And a three-dimensional view of the roller is shown in FIG. 3C. In FIG. 3A, it depicts the novel configuration of the roller polishing pad conditioner of the present invention on a disk polishing pad. The wafer holder 302 is used to hold a semiconductor wafer (not shown). Besides, a plurality of conditioning units 300 are integrated to one set of the conditioner, and each unit is a roller conditioner. And the conditioning units are arranged along radial direction successively. Because the peripheral path length near the center of the polishing pad is shorter than that near the edge, the diameter of the roller of a conditioning unit near the center of the polishing pad 304 is smaller than that of the roller near the edge of the polishing pad, such that the conditioning efficiency is uniform on all over the polishing pad. Additionally, it's optional to employ one or a plurality of megasonic (or ultrasonic) cleaning apparatus 306 is set to further improve the polishing pad defects. The operation of the megasonic (or ultrasonic) cleaning apparatus 306 is to transmit megasonic waves generated by an oscillator to the wafer via water in order to clean the surface of the wafer (not shown).

Figure 4A:
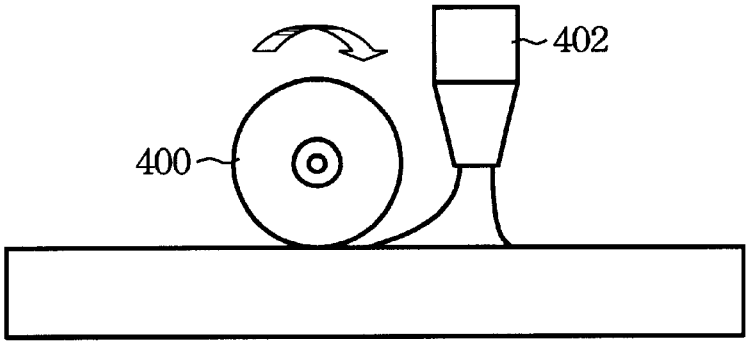
FIG. 4A is a cross-sectional view of a roller polishing pad conditioner of the present invention and a megasonic cleaning apparatus.
Figure 4B:
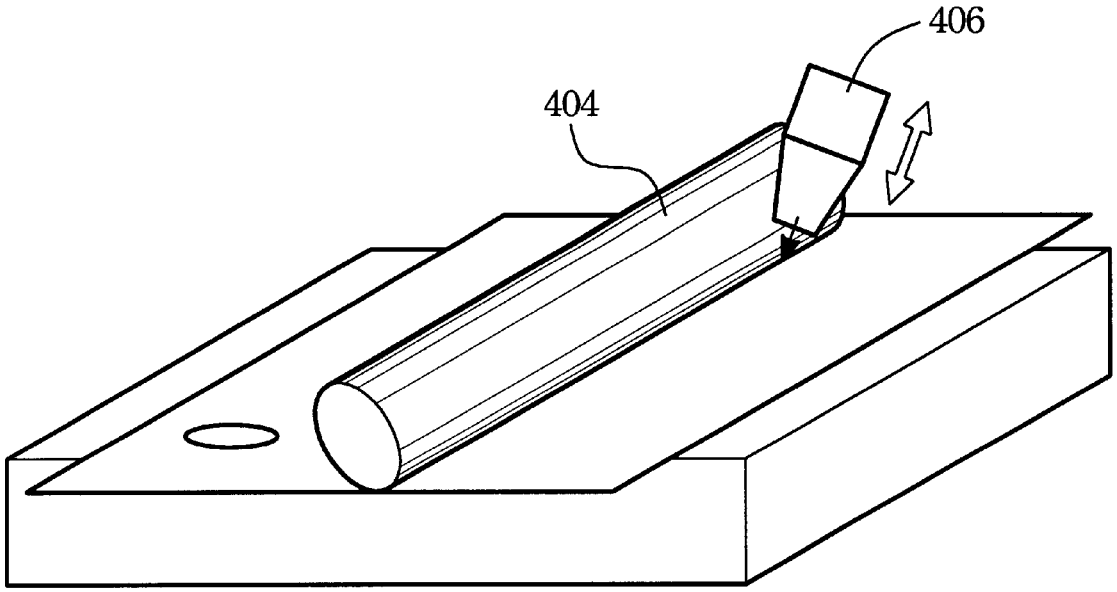
FIG. 4B is a three-dimensional view of a roller polishing pad conditioner of the present invention and a megasonic cleaning apparatus.

FIG. 4A depicts the operation of a roller polishing pad conditioner 400 and the accompanying megasonic (ultrasonic) cleaning apparatus 402. Referring to FIG. 3B, it's a top view schematic diagram of a polishing apparatus and one set of polishing pad conditioner of the present invention on a linear polishing pad. Each of the rollers 308 has grinding layer around its cylindrical side and is operated independently to provide different down-pressure on the polishing pad 310. If the down-pressure applied on the polishing pad 310 is relatively high, the removal rate is thus relatively high. Additionally, the rotating speed of a roller can be adjusted to provide a specific removal rate of a conditioning process. Therefore, a specific profile of the polishing pad 310 can be obtained by adjusting the down-pressure and the rotating speed of the individual roller. The down-pressure and the rotating speed of the individual roller are controlled by a down-pressure controller and a speed controller (not shown), respectively. Because the rollers are operated separately, a multi-zone conditioning effect can be obtained. In a preferred embodiment, the configuration of a roller conditioner 404 and a megasonic (ultrasonic) cleaning apparatus 406 is shown in FIG. 4B.

Figure 5:
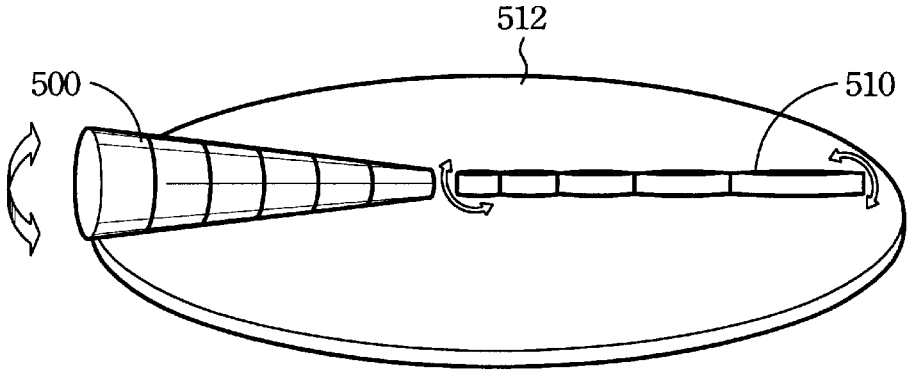
FIG. 5 is a configuration of a roller and disk conditioner of the present invention on a disk polishing pad.
Figure 6:
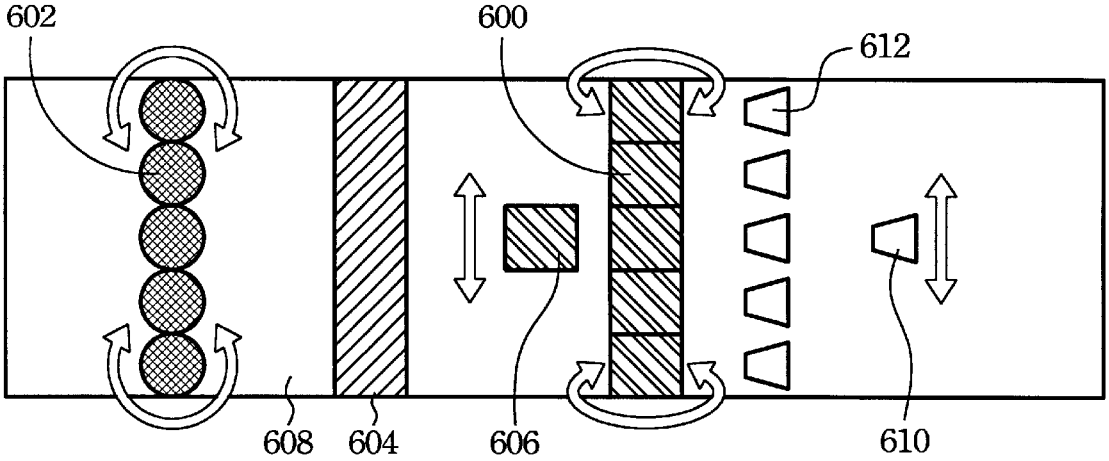
FIG. 6 depicts multiple configurations of a roller or disk conditioner of the present invention on a linear polishing pad.

Another embodiment of the present invention is to employ a disk conditioner with an abrasive grinding layer on downward side. The configuration of the roller conditioner 500, the disk conditioner 510 and the disk polishing pad 512 is shown in FIG. 5. The disk conditioner 510 operates in a similar way as in the roller conditioner, i.e., the down-pressure and the rotating speed of each disk can be adjusted to condition the disk polishing pad 512, and a desired profile of the disk polishing pad 512 can be obtained. Referring to FIG. 6, it depicts multiple configurations of a set of rollers 600 or disks polishing pad conditioner 602 of the present invention on a linear polishing pad 608. A single roller conditioner 604 establishes another one configuration. A single roller conditioner 606, which is smaller than the single roller conditioner 604, establishes still another one configuration. And the single roller conditioner 606 is movable to condition the linear polishing pad 608. In addition, one or a plurality of megasonic (ultrasonic) cleaning apparatuses can be set up. For example, the single megasonic cleaning apparatus 610 is movable alone the surface of the linear polishing pad 608. A set of megasonic cleaning apparatuses 612 is another one embodiment. In order to smooth the sharp edge of the portion been conditioning; that is, to get a better uniformity of the polishing pad, the conditioner 600 or 602 is made to swing horizontally at a small angle.

Figure 7:
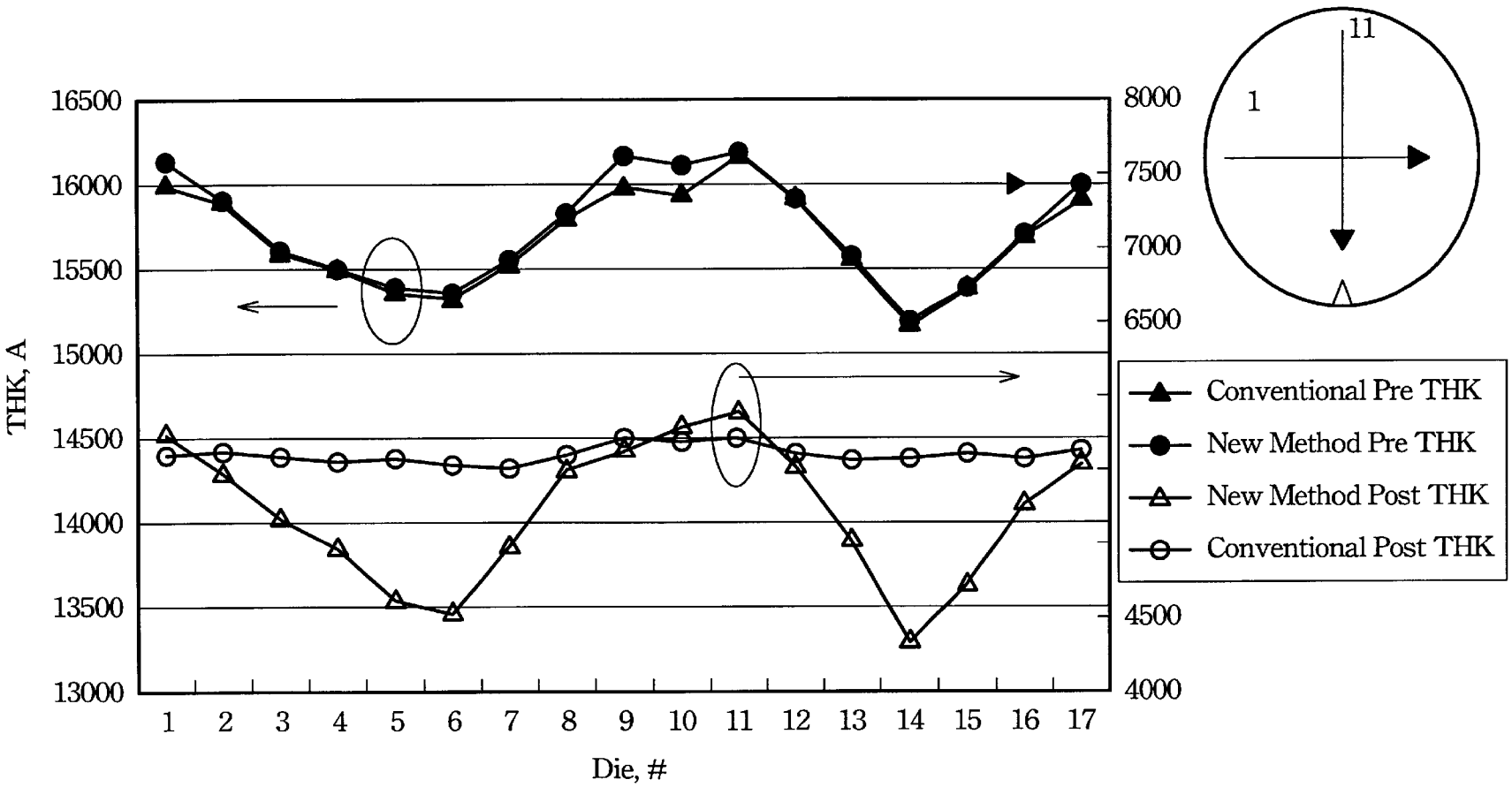
FIG. 7 is a statistical chart of the pre-THK and post-THK, which is compared between a conventional method and that of the present invention.

The advantageous performance of the multi-zone conditioning method disclosed in the present invention is demonstrated in FIG. 7. It is a statistical chart of the pre THK and post THK, which is a comparison result of a conventional method and that of the present invention. And it can be readily appreciated that the present invention provides a superior conditioning for a polishing pad of CMP system. The profile of the polishing pad after THK by employing a conventional conditioner is highly correlated with that of the polishing pad before THK. However, a highly quality of planarization can be obtained by employing the method disclosed in the present invention.

As is understood by a person skilled in the art, the foregoing preferred embodiments of the present invention that are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An apparatus for conditioning a polishing pad of a chemical mechanical polishing system comprising:

a plurality of rollers with an abrasive grinding layer around the cylindrical sides thereof, the diameters of said plurality of rollers near the center of said polishing pad being smaller than those near the edge of said polishing pad;

a first means for adjusting the amount of down-pressure exerted by said plurality of rollers against said polishing pad; and a second means for adjusting rotating speed of said plurality of rollers.

2. The apparatus according to claim 1, wherein said plurality of rollers are arranged along radial direction successively.

3. The apparatus according to claim 1, wherein said plurality of rollers are adapted to swing horizontally on said polishing pad.

4. A apparatus for conditioning a polishing pad of a chemical mechanical polishing system comprising:

a plurality of disks with an abrasive layer on downward side thereof;

a first means for adjusting the amount of down-pressure exerted by said plurality of disks against said polishing pad; and a second means for adjusting rotating speed of said plurality of disks.

5. The apparatus according to claim 4, wherein said plurality of disks are arranged along radial direction successively.

6. The apparatus according to claim 5, wherein diameters of said plurality of disks near the center of said polishing pad are smaller than those near the edge of said polishing pad.

7. The apparatus according to claim 5, wherein said plurality of disks are adapted to swing horizontally on said polishing pad.

8. A method for conditioning a polishing pad comprising the steps of:

providing said polishing pad;

presetting an amount of down-pressure exerted by a roller conditioner;

applying said amount of down-pressure to said polishing pad;

presetting an amount of rotating speed of said roller conditioner;

rotating said roller conditioner at a rotating speed of said amount;

polishing said polishing pad; and cleaning said polishing pad by employing a megasonic or ultrasonic cleaning apparatus.

9. The method according to claim 8, wherein said roller conditioner comprising a plurality of rollers with an abrasive grinding layer around the cylindrical sides thereof.

10. The method according to claim 9, further comprising a step to make said plurality of rollers swing horizontally on said polishing pad.

11. A method for conditioning a polishing pad comprising the steps of:

providing said polishing pad;

presetting an amount of down-pressure exerted by a disk conditioner;

applying said amount of down-pressure to said polishing pad;

presetting an amount of rotating speed of said disk conditioner;

rotating said disk conditioner at a rotating speed of said amount; and polishing said polishing pad.

12. The method according to claim 11, wherein said disk conditioner comprising a plurality of disks with an abrasive grinding layer on downward side thereof.

13. The method according to claim 11, further comprising a step to clean said polishing pad by employing a megasonic or ultrasonic cleaning apparatus.

14. The method according to claim 11, further comprising a step to make said plurality of disks swing horizontally on said polishing pad.

* * * * *